United States Patent [19]

Braun

[11] 4,171,168

[45] Oct. 16, 1979

[54] EMBOUCHURE PENS HAVING PLURAL CONTIGUOUS NIBS

[76] Inventor: Ben Braun, 15 Georgia Dr., Syosset, N.Y. 11791

[21] Appl. No.: 826,502

[22] Filed: Aug. 22, 1977

[51] Int. Cl.[2] ..... B43K 17/00

[52] U.S. Cl. ..... 401/35; 401/256; 401/261

[58] Field of Search ..... 401/35, 256, 257, 221, 401/292, 231, 258, 264–267, 261

[56] References Cited

U.S. PATENT DOCUMENTS

| | | | |
|---|---|---|---|
| 2,554,335 | 5/1951 | Kollsman | 401/35 |
| 2,753,845 | 7/1956 | Miessner | 401/261 |
| 3,871,776 | 3/1975 | Braun | 401/256 |
| 3,887,287 | 6/1975 | Rosh, Jr. | 401/35 |
| 3,950,106 | 4/1976 | Braun | 401/256 |

*Primary Examiner*—Clifford D. Crowder
*Attorney, Agent, or Firm*—A. C. Nolte, Jr.; Edward B. Hunter

[57] ABSTRACT

A pen of the embouchure type having a pair of contiguous nibs for a writing tip comprising at least one pair of shaped lips forming a curvate capillary mouth and being flexible to permit a slit formed by the lips to vary in breadth with the pressure applied upon the tip to produce an ink track of corresponding breadth; such a pen formed of flexible material with strengthening structural formations; and such a pen in which a plurality of writing tips may be formed at the nib end; the multitipped nib end being formed either from a tube or tubes of flexible material or from a sheet or sheets of flexible material.

9 Claims, 16 Drawing Figures

EMBOUCHURE PENS HAVING PLURAL CONTIGUOUS NIBS

BACKGROUND OF THE INVENTION

This invention is directed to improvements in writing instruments of the embouchure type as disclosed and claimed in U.S. Pat. Nos. 3,871,776 and 3,950,106. Such prior art pens provide single track pens with mouthed nib portions which are fabricated from flexible nested tubes or from a single flexible tube folded within itself along fold axes.

The invention is also directed to multilinear writing instruments of the embouchure type, and in this respect, it is noted that multilinear writing instruments have been used by artists and calligraphers, principally for lettering and decorative effects. They are generally improvised by ganging two or more conventional writing instruments. However, such tools have the drawback that they are cumbersome and lack flexibility, thus making them difficult to handle; and providing no means for increasing or decreasing the width of the writing track of the ganged tips.

Typical multilinear writing instruments of the prior art are disclosed in U.S. Pat. Nos. 265,885, 519,953, 549,098, 1,254,701, 1,727,110 and 3,107,654.

Similarly, multilinear writing instruments have been provided with a multiplicity of writing tips formed to extend from a single shaft. In this connection, see the old U.S. Pat. Nos. to Handle, 417,024, to Fuller 510,966, to Walter 594,186, to Hallock 946,036 and the later patents to Rosh 3,887,287 and Andaloro 3,164,906.

OBJECTS OF THE INVENTION

It is an object of the invention to provide an embouchure pen in which the writing or nib end though flexible is constructed with a structural ridge formation which strengthens the nib and permits the use of a wider range of materials for its fabrication, including very thin walled metals and the relatively softer nylons and vinyls, as opposed to mylar for instance, which tends to be relatively stiff though resilient and is difficult to use in fabricating embouchure pens of the type described.

In one embodiment of the invention, the pen is formed from a tube of material as disclosed in U.S. Pat. No. 3,871,776, and the strengthening element is a simple corrugation which also separates the writing tracks of a multilinear or multitrack pen.

It is another object of the present invention to provide a writing pen of the embouchure type in which the lips forming the capillary mouth thereof are formed from a sheet of material as opposed to a tube of material, the joinder of the outer edges of the sheet providing a central structural formation along upstanding flanges extending along the ink channel of the pen and in a single track embodiment, along the plane passing through the common axis of the curved lips of the writing nib. This flanged construction of the invention provides for structural integrity of the embouchure pen, and in a single track pen, is also advantageous for forming a more flattened tip, as opposed to the more curved construction used in prior art pens of the embouchure type. As shall be appreciated by those in the calligraphic arts, such a construction permits a more facile ability to write in the Italic or old Italian style.

The multilinear pen of the invention may be formed with the flanged construction and may also be formed with the double or single tube constructions also described above.

A further object of the invention as it concerns multilinear writing instruments is to provide such an instrument which is not subject to the drawbacks of the prior art; that is to provide such a pen with means for controlling the shading, either uniform or graduated from one tracking element to the next, as desired.

Included within the objects of the invention as it concerns a multilinear writing instrument, is the provision of such a pen with reservoir means for two or more liquids, such as different colored inks and which feed respective writing tips to produce multichromatic lines.

Furthermore, the invention as it concerns multilinear writing instruments, proposes a compound embouchure wherein a plurality of writing tips are arranged in groups to produce respective lines of shading. The depth or degree of shading is determined by the respective curvatures of the tips, the width of the intermediate spaces therebetween and the relative distribution of writing pressure thereon. By this means, the writer can with a single stroke of the pen form a character or letter which is uniformly shaded or graduated as desired with intermediate lines of shading therebetween. As just noted, the writing may be further enhanced through the use of multifeed means whereby inks of various colors may be dispensed to produce multichromatic lines of shading.

The inventions in embouchure pens will best be understood by referring now to the accompanying drawings in conjunction with the specification which follows, and in which drawings.

Figure 6:
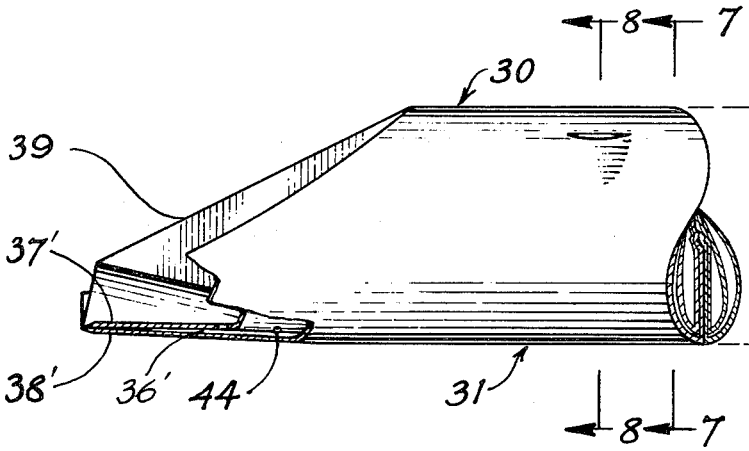
FIG. 6 is a side view of another embodiment of the invention in a multilinear pen showing a flanged sheet construction, with a portion of the forward end cut away to show a longitudinal section thereof.
Figure 7:
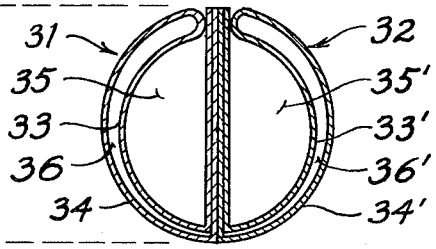
Figure 8:
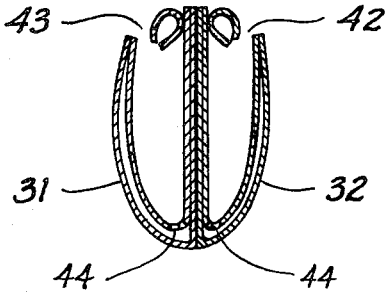
Figure 9:
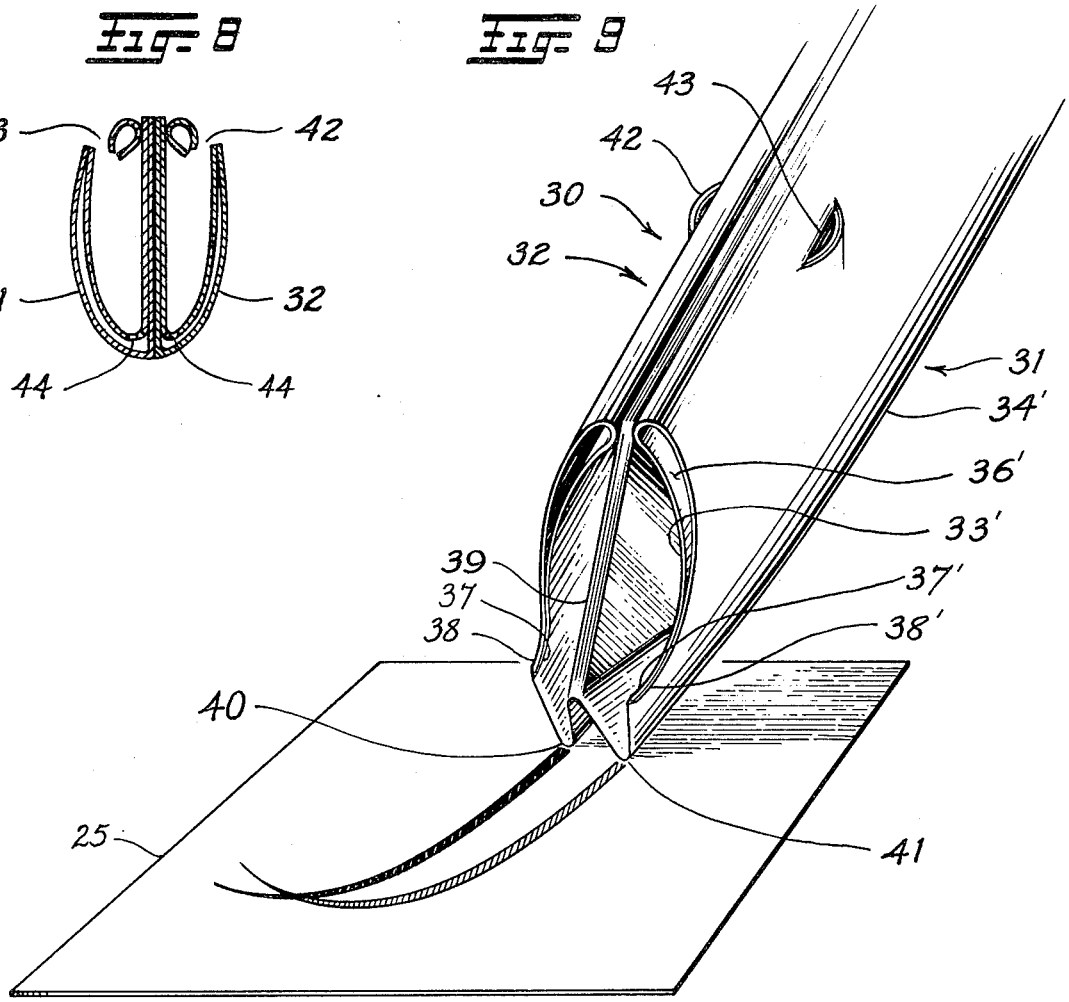

FIGS. 7 and 8 are transverse sections of the pen taken on lines 7—7 and 8—8 of FIG. 6;

FIG. 9 is a perspective view of the duplex pen in position of use.

Figure 10:
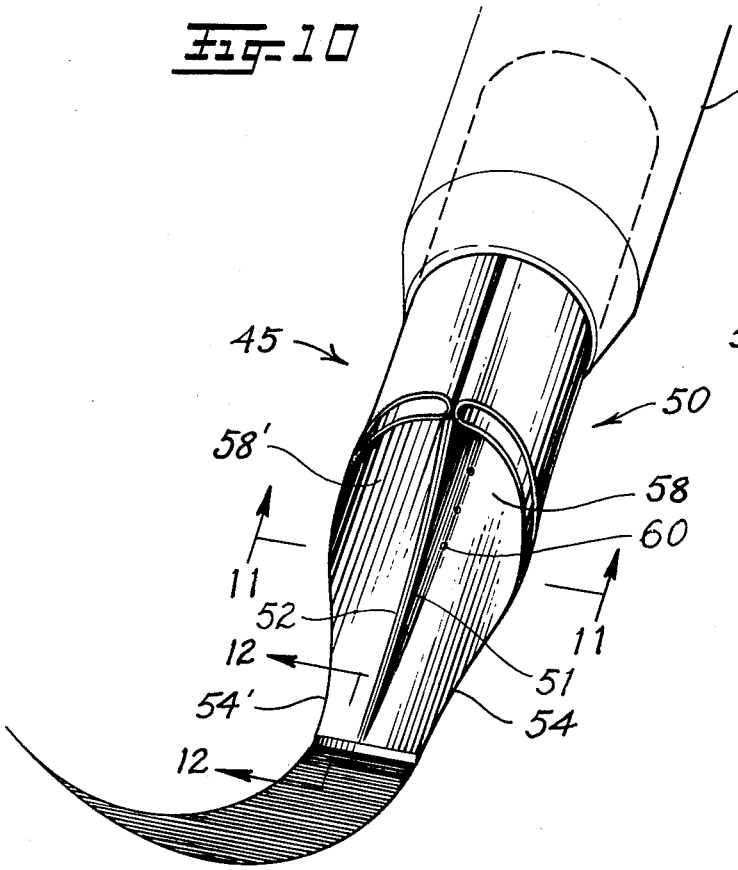
Figure 11:
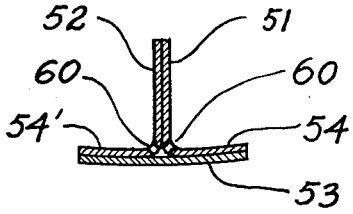
Figure 12:
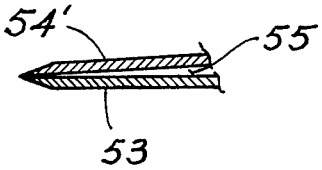
Figure 13:
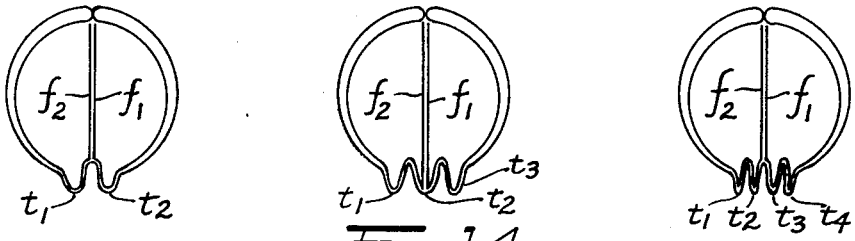

FIG. 10 is a perspective view of yet another embodiment of the invention showing the flanged sheet construction in a single track nib end;

FIGS. 11 and 12 are sectional views taken along the lines 11—11 and 12—12 of FIG. 10;

FIG. 13 comprises schematic views of pens fabricated in accordance with construction of the pen of FIG. 10, but including plural writing tips.

Figure 14:
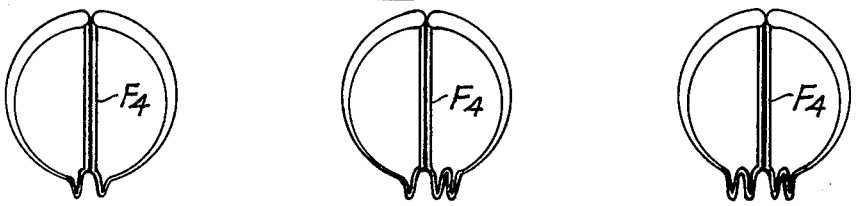
Figure 15:
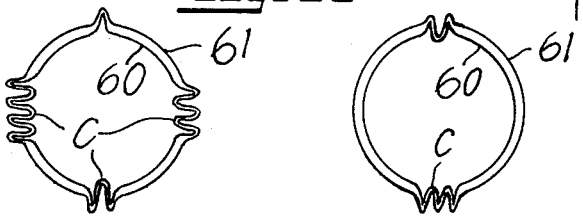

FIG. 14 comprises schematic views of pens fabricated in accordance with the construction of the pen of FIG. 6; and FIG. 15 comprises schematic views of pens fabricated from nested tubes and including a plurality of nib ends with writing tips of varying number disposed about the periphery of the nib ends.

Figure 16:
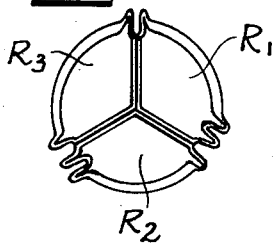

FIG. 16 is a schematic view of a pen having a plurality of nib ends with writing tips of varying number disposed about the periphery of the nib end and providing for a plurality of reservoir or feed means.

Figure 1:
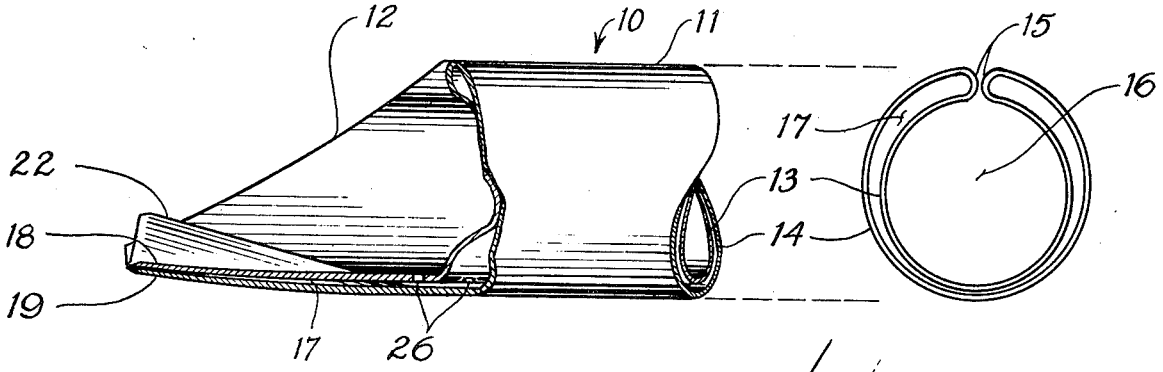
FIG. 1 is a side view of an embodiment of the invention in a multilinear pen showing a corrugated construction, with a portion of the forward end cut away to show a longitudinal section thereof.
Figure 2:
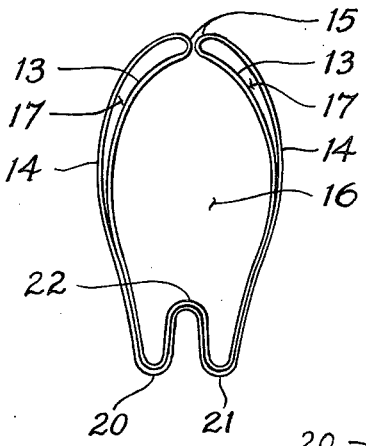
FIG. 2 is a front view of the pen of FIG. 1.
Figure 3:
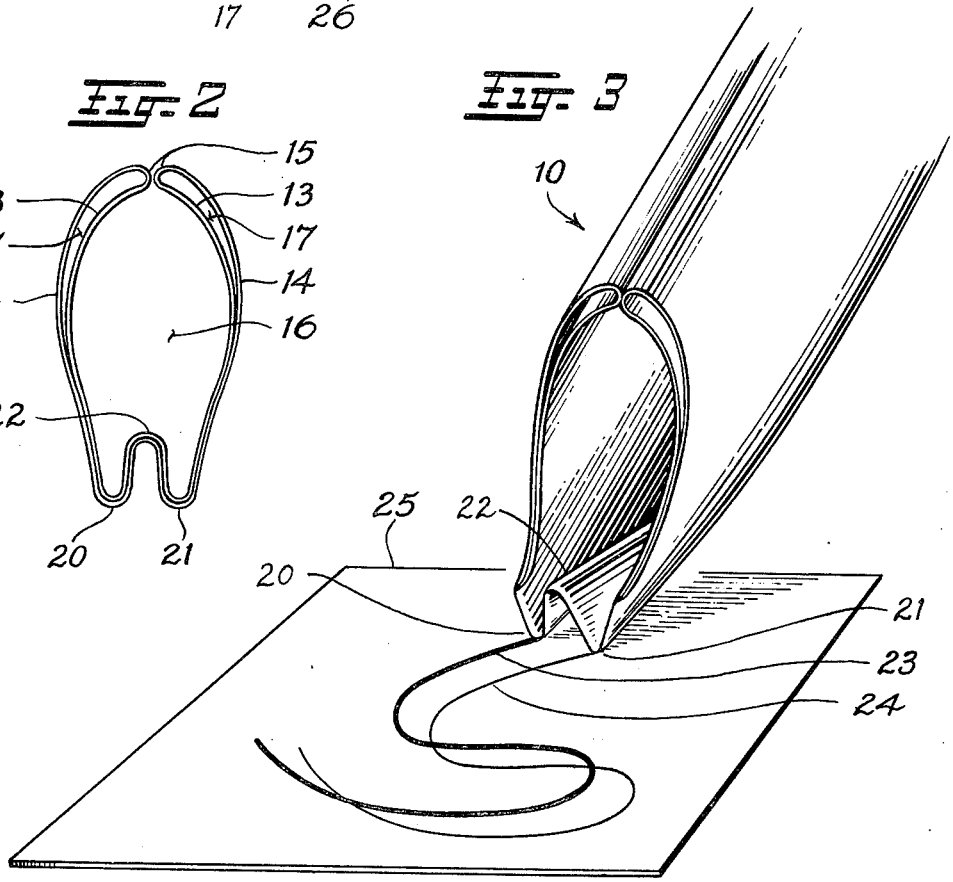
FIG. 3 is a perspective view of the pen of FIG. 1, shown in a position of use.

Referring to the drawings and in particular to FIGS. 1 to 3, there is shown a pen constructed in accordance with the form as set forth in U.S. Pat. No. 3,871,776, and embodying the principles of the present invention. For simplicity a double-track pen has been chosen as the illustrative embodiment of the invention. The pen body 10 is formed of a tube of resilient material such as resin plastic and is shown to have a substantially cylindrical shank end 11 to provide support and a substantially conical mouth end 12 for tracking ink therewith. The pen body 10 comprises two body portions 13 and 14 which are disposed in nesting relationship by means of longitudinal fold axes 15 and define an axial through passage 16 to provide an ink receptacle and an intermediate space 17 to constitute an ink feeding channel. A series of perforations 26 provides means of communication between passages 16 and 17. The body portions terminate at their forward ends in respective abuting lips 18 and 19 which are relatively more flexible than the rest of the pen body. The writing end of the pen is folded or puckered in the form of a corrugation 22 to form two smaller mouth-like orifices 20 and 21 on opposite sides thereof to constitute a compound writing tip. The corrugation 22 also acts to strengthen the writing end of the pen.

When writing pressure is applied to the tip of the pen, the orifices 20 and 21 are distended by progressive spring contact into cross slits, as shown in FIG. 3, to produce respective lines 23 and 24 of corresponding breadth on paper surface 25. It will be noted that line 23 is shown to be relatively heavier than line 24 indicating that the writing pressure was biased in favor of tip 20. Of course, the same effect could also be accomplished by having the free curvature of tip 20 fabricated smaller than that of tip 21.

Figure 4:
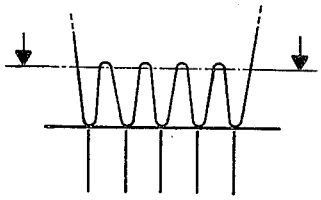
FIG. 4 is a schematic view of a five-track multilinear pen embodying the inventions disclosed and in which the tracks are under uniform distribution of writing pressure.
Figure 5:
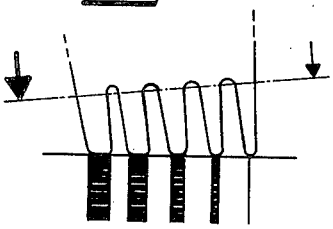
FIG. 5 is a schematic view of the pen of FIG. 4, under graduated distribution of writing pressure.

FIGS. 4 and 5 illustrate schematically a five-track multilinear pen which may be made in accordance with the corrugated construction of FIGS. 1–3 and in which the respective tips thereof preferably extend in side-by-side relation along a common plane, so that when they are subjected first to uniform pressure as in FIG. 4, and then to biased-pressure as in FIG. 5, to produce respectively, lines of uniform shading and lines of graduated shading.

In another embodiment of the invention; shown in FIGS. 6 through 9, the pen is quite similar to that previously described except that it has two modular units to form a duplex pen. In this construction the pen body 30 is shown to comprise two bodies 31 and 32 which are substantially semicylindrical in form and arranged symmetrically with respect to the vertical axial plane of the pen. Each body has respective inner and outer portions, 33, 33' and 34, 34' defining axial openings 35, 35' and intermediate ink feeding channels 36, 36' which terminate at their forward ends in respective abuting lips 37, 38 and 37', 38' to constitute a compound embouchure with respective mouth-like orifices 40 and 41 for tracking ink therewith. Each unit 31 and 32 is provided with a peripheral slit or pocket 42 and 43 respectively for filling each module with different colored inks by means of an ink dropper, or other means. A series of perforations 44 provides means of communication between the passages 35, 36 and 35', 36'.

Each modular unit or body 31, 32 is constructed from a sheet of material, as opposed to a tube of material used in forming the pen of FIGS. 1–3, and the strengthening ridge structure 39 of this embodiment of the invention is the centrally cemented or otherwise connected flanges of the units formed by the adjoining of the edges of the sheets from which the units are formed.

In operative use, the tips of the pen 30 will track lines of different color and the relative thicknesses of the respective lines can be made to vary accordingly as writing pressure is shifted from one side of the pen to the other, presenting altogether new and highly ornamental effects. The adjoining tips of the pen are so arranged that the ensuing lines come together or separate at the will of the operator. Further novel effects may be created by incorporating a larger number of such modular units of various shape into the pen body so that the pen could dispense a broader range of multichromatic lines in the writing.

As will be appreciated, the pens of the invention just described may be embodied in a construction in which the pen comprises a pen body, the shank end of which fits into a pen barrel.

Such a construction is shown in FIG. 10 in which the pen 45 comprises a barrel 46 in which is fitted a pen body 50, formed of a single sheet of flexible material, the ends of which are joined, via cement or other adjoining techniques along a formed pair of flanges 51, 52 extending centrally of the pen body; i.e., along the vertical central plane passing through the pen body. As in the constructions previously discussed, the pen body is formed by folding the sheet along symmetrical longitudinal fold axes, to form a pair of integral, substantially trough-shaped segments or nibs and having contiguous surfaces 53, 54 (54') and defining therebetween a channel 55 (FIG. 12) for ink.

As the central flange construction of this embodiment lends itself to the forming of a flatter writing track, the lips may be bevelled to further flatten the writing tip as shown in FIG. 12 to thereby increase the thick to thin line contrast ratio and to further facilitate Italic style writing.

The connected flanges 51, 52 extending from the central point of the inner contiguous surface 54, 54' provides the strengthening structural ridge element in this embodiment which permits the use of more flexible materials for the fabrication of pens of the embouchure type, and these forms on either side thereof through passages 58, 58' which constitute ink passages from which the channel 55 may receive ink through apertures 60 formed along the inner fold lines of the flanges.

As shown schematically in FIG. 13, the construction of FIG. 10 is readily modified to provide multilinear writing instruments with one or more writing tips $t_1$, $t_2$, $t_3$, etc. disposed on either side of the joined flanges $f_1$, $f_2$.

FIG. 14 shows schematically multilinear writing pens constructed in accordance with the modular construction of FIG. 9, in which the four flanges $F_4$ of two modular sheet units variously separate different numbers of writing tips. As can be appreciated, more than two modular units can be joined to supply as many chromatic tracks as desired.

FIG. 15 shows schematically multilinear pens constructed in accordance with the nested tubes construction of U.S. Pat. No. 3,950,106 in which inner and outer tubes 60, 61 respectively may be corrugated as at C to provide strengthening elements as well as to separate separate writing tips about the periphery of the nib end.

FIG. 16 shows schematically a multilinear pen constructed in accordance with any of the embodiments discussed herein, but which provides three reservoirs R1, R2, R3, which may feed ink of different colors to the respective writing tips. As may be appreciated, feed apertures, not shown in FIG. 16, as shown in FIG. 9 (feed apertures 42, 43) may be provided for each reservoir or any other type of feeding means may be supplied dependent upon the construction used. It is also noted that different colored inks may be supplied to one writing tip on one side of a reservoir wall and two writing tips on the other side of a reservoir wall, etc. so that varying numbers of writing tips having different colored inks may be used for various effects.

As will be apparent from the above, the invention is not restricted to the embodiments shown and described but may be encompassed in many variations including the use thereof in a fountain pen construction.

In any event, the inventions disclosed herein are not to be limited by the disclosed embodiments but only by the claims which now follow.

I claim:

1. In an embouchure pen made of resilient material and comprising opposed inner and outer nibs forming at forward ends thereof contiguous outer and inner lips constituting means for tracking ink, the improvement comprising structural means in at least one of said nibs for stiffening the lips of said pen and comprising an elongated ridge extending from the forward end of said pen longitudinally rearwardly.

2. In an embouchure pen of claim 1, wherein said stiffening means comprises at least one corrugation formed in said opposed nibs to thereby form a plurality of said tracking means, at least one of said tracking means being disposed on either side of said corrugation.

3. In the embouchure pen of claim 1 wherein said opposed nibs are formed from a sheet of said resilient material with the edges thereof folded to form flanges extending from said inner nib, said flanges being connected and constituting said stiffening means.

4. In the embouchure pen of claim 3 in which the outer and inner lips are bevelled along their respective edges at the forward extremities thereof to diverge rearwardly forming the tips of said lips thin along their lines of adjacency.

5. In the embouchure pen of claim 1 wherein at least two sets of inner and outer nibs are formed from a sheet of said resilient material with the edges thereof folded to form flanges along a side of each set of nibs, and the flanges of each set are joined to form a central wall between the sets and which comprises said stiffening means.

6. In the embouchure pen of claim 5 wherein each set of nibs includes aperture means constituting means for feeding ink between the respective inner and outer nibs.

7. In the embouchure pen of claim 1 wherein a plurality of means for tracking ink are provided.

8. In the embouchure pen of claim 7 wherein separate reservoir means are provided for each tracking means.

9. In the embouchure pen of claim 1, in which the outer and inner lips are bevelled along their respective edges at the forward extremities thereof to diverge rearwardly forming the tips of said lips thin along their lines of adjacency.

* * * * *